US012669270B2

(12) United States Patent
Rendall et al.

(10) Patent No.: US 12,669,270 B2
(45) Date of Patent: Jun. 30, 2026

(54) STATE OF CHARGE SENSOR FOR PHASE CHANGE MATERIAL THERMAL ENERGY STORAGE

(71) Applicant: UT-BATTELLE, LLC, Oak Ridge, TN (US)

(72) Inventors: Joseph D. Rendall, Oak Ridge, TN (US); Som S. Shrestha, Knoxville, TN (US); Anthony C. Gehl, Knoxville, TN (US); Jerald A. Atchley, Louisville, TN (US); Diana Hun, Lenoir City, TN (US); Zhenglai Shen, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 207 days.

(21) Appl. No.: 18/208,551

(22) Filed: Jun. 12, 2023

(65) Prior Publication Data

US 2024/0310082 A1 Sep. 19, 2024

Related U.S. Application Data

(60) Provisional application No. 63/353,340, filed on Jun. 17, 2022.

(51) Int. Cl.
*F24V 99/00* (2018.01)

(52) U.S. Cl.
CPC ..... *F24V 99/00* (2018.05)

(58) Field of Classification Search
CPC ..... F24V 99/00; G01L 7/08; G01L 13/025; G01L 23/18; F28D 20/028; F28F 27/00
See application file for complete search history.

(56) References Cited

U.S. PATENT DOCUMENTS 4,275,392 A * 6/1981 Bischofberger .... F15B 15/2838 340/606
2022/0163270 A1* 5/2022 Maharmeh ..... F28D 20/028

FOREIGN PATENT DOCUMENTS

WO 2014191778 A1 12/2014

OTHER PUBLICATIONS

Abdulateef, A. M., Mat, S., Abdulateef, J., Sopian, K., & Al-Abidi, A. A. (2018). Geometric and design parameters of fins employed for enhancing thermal energy storage systems: a review. Renewable and Sustainable Energy Reviews, 82(Jun. 2017), 1620-1635, https://doi.org/10.1016/j.rser.2017.07.009.

(Continued)

*Primary Examiner* — Travis Ruby
(74) *Attorney, Agent, or Firm* — Fox Rothschild LLP

(57) ABSTRACT

A thermal energy storage system includes a heat exchange module having a quantity of phase change material and a quantity of reference gas in fluid communication with the phase change material. A sensor is provided for sensing the reference gas pressure and generating a pressure signal that is related to the reference gas pressure. The exchange of heat changes the heat of the phase change material, a change in the phase of the phase change material, and a change in the total volume of the phase change material. This changes the volume of the reference gas, and also changes the reference gas pressure. The sensor will detect and generate a signal of the reference gas pressure change and form this a change in the state of charge of the phase change material can be determined. A thermal energy storage system and method for storing thermal energy are also disclosed.

8 Claims, 4 Drawing Sheets

(56) References Cited

OTHER PUBLICATIONS

Fang, X., Fan, L. W., Ding, Q., Yao, X. L., Wu, Y. Y., Hou, J. F., . . . Hu, Y. C. (2014). Thermal energy storage performance of paraffin-based composite phase change materials filled with hexagonal boron nitride nanosheets. Energy Conversion and Management, 80, 103-109. https://doi.org/10.1016/j.enconman.2014.01.016.

Fauzi, H., Metselaar, H. S. C., Mahlia, T. M. I., & Silakhori, M. (2014). Sodium laurate enhancements the thermal properties and thermal conductivity of eutectic fatty acid as phase change material (PCM). Solar Energy, 102, 333-337. https://doi.org/10.1016/j.solener.2013.07.001.

Lachheb, M., Karkri, M., Albouchi, F., Mzali, F., & Nasrallah, S. Ben. (2014). Thermophysical properties estimation of paraffin/graphite composite phase change material using an inverse method. Energy Conversion and Management, 82, 229-237. https://doi.org/10.1016/j.enconman.2014.03.021.

Lin, W., Zhang, W., Ling, Z., Fang, X., & Zhang, Z. (2020). Experimental study of the thermal performance of a novel plate type heat exchanger with phase change material. Applied Thermal Engineering, 178, 115630. https://doi.org/ https://doi.org/10.1016/j.applthermaleng.2020.115630.

Mehrali, M., Tahan Latibari, S., Mehrali, M., Mahlia, T. M. I., Sadeghinezhad, E., & Metselaar, H. S. C. (2014). Preparation of nitrogen-doped graphene/palmitic acid shape stabilized composite phase change material with remarkable thermal properties for thermal energy storage. Applied Energy, 135, 339349. https://doi.org/10.1016/j.apenergy.2014.08.100 <https://doi.org/10.1016/j.apenergy.2014.08.100>.

Peng, S., Fuchs, A., & Wirtz, R. A. (2004). Polymeric phase change composites for thermal energy storage. Journal of Applied Polymer Science, 93(3), 1240-1251. https://doi.org/10.1002/app.20578.

Rahimi, M., Ranjbar, A. A., Ganji, D. D., Sedighi, K., Hosseini, M. J., & Bahrampoury, R. (2014). Analysis of geometrical and operational parameters of PCM in a fin and tube heat exchanger. International Communications in Heat and Mass Transfer, 53, 109-115. https://doi.org/10.1016/j.icheatmasstransfer.2014.02.025.

Woods, J., Mahvi, A., Goyal, A., Kozubal, E., Odukomaiya, A., & Jackson, R. (2021). Rate capability and Ragone plots for phase change thermal energy storage. Nature Energy, 6(3), 295-302. https://doi.org/10.1038/s41560-021-00778-w.

Wu, J., Feng, Y., Liu, C., & Li, H. (2018). Heat transfer characteristics of an expanded graphite/paraffin PCM-heat exchanger used in an instantaneous heat pump water heater. Applied Thermal Engineering, 142, 644-655. https://doi.org/https://doi.org/10.1016/j.applthermaleng.2018.06.087.

Youssef, W., Ge, Y. T., & Tassou, S. A. (2018). CFD modelling development and experimental validation of a phase change material (PCM) heat exchanger with spiral-wired tubes. Energy Conversion and Management, 157, 498510. https://doi.org/10.1016/j.enconman.2017.12.036 <https://doi.org/10.1016/j.enconman.2017.12.036>.

Thermal Conductivity Instruments, Fox Instruments Product Catalogue, TA Instruments 2015, www.lasercomp.com.

* cited by examiner

STATE OF CHARGE SENSOR FOR PHASE CHANGE MATERIAL THERMAL ENERGY STORAGE

CROSS-REFERENCE TO RELATED APPLICATIONS

This application claims priority to U.S. 63/353,340 filed on Jun. 17, 2022, entitled "State of Charge Sensor for Phase Change Material Thermal Energy Storage", the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates generally to thermal energy storage apparatus and methods, and more particularly to thermal energy storage apparatus and methods incorporating phase changing materials.

BACKGROUND OF THE INVENTION

The building sector accounts for 40% of the global energy consumption and an increase of 28% by 2035 has been predicted. To reduce the energy consumption of buildings and the associated $CO_2$ emissions, the U.S. Department of Energy supports the development of low-cost phase change material (PCM) and PCM based thermal energy storage systems. A PCM based thermal energy storage system was found to be promising from the efficiency and economical point of view. The advantages of thermal energy storage using PCMs include high storage density and constant temperature behavior during the phase change, allowing a high heat transfer rate compared to sensible heat transfer. More importantly, it can shift the electric load for building space conditioning and therefore it has been increasingly applied in building thermal management.

The performance of latent heat storage systems depends on the thermophysical properties of the PCM, the design of heat exchanger, and the contact thermal resistance between them. Commonly used PCMs for building thermal energy storage mainly include organic PCMs, inorganic PCMs, and eutectic PCMs.

Organic PCMs have been increasingly studied because of their relatively high latent heat capacity, appropriate phase-transition temperature, stable physical and chemical characteristics, non-corrosive properties, and congruent melting. However, pure organic PCMs show some shortcomings which may limit their usage, including low thermal conductivity, e.g., usually less than 0.5 W/mK, high volume variation and liquid seepage during stage changes.

Organic PCMs can be categorized as paraffin organic PCMs and non-paraffin organic PCMs. Paraffin is composed of a straight chain alkane mixture. The range of a paraffin's melting point is from −12° C. to 71° C. and these materials can store 128 kJ/kg to 198 kJ/kg of heat. Paraffin materials are examples of popular PCMs used because they are non-corrosive and non-subcooling. In addition, paraffin materials are stable and experience relatively small volume changes during phase change. However, they have a relatively low thermal conductivity, e.g., usually 0.21-0.24 W/mK, which may limit their application for thermal energy storage applications. Non-paraffin PCMs include alcohols, esters, glycols, and fatty acids, which have a variety of properties and are intensively researched.

Inorganic PCMs usually have higher heat of fusion per unit mass with lower cost. The most used inorganic PCM is salt hydrates, which include a category of inorganic salts containing one or multiple water molecules. They suffer from super cooling phase segregation, lack of thermal stability, corrosion, and decomposition. Therefore, thermal energy storage systems should be carefully designed to deliver the desired properties when using hydrated salts.

Eutectic PCMs are the combination of at least two other PCMs. The purpose of developing eutectic PCM is mainly to combine the advantages of different PCMs. For example, the combination of organic and inorganic PCMs may lead to higher thermal conductivity than the constitute organic PCM while having reduced cost.

PCM based heat exchangers can be broadly divided into shell-and-tube heat exchangers and finned heat exchangers. Depending on the placement of PCM and number of tubes, shell-and-tube heat exchangers can be further divided into cylinder model, multi-tube model and pipe model.

In the cylinder model, PCM is placed in the shell and heat transfer fluid (HTF) passes through the inner tube. The multi-tube model includes more than one tube. It is noted that the cylinder model is the most used type of heat exchanger for latent heat storage systems due to its simplicity. In the pipe model, PCM is placed in the inner tube and HTF passes through the annulus.

To increase the heat transfer efficiency, finned heat exchangers have attracted more research interest recently. Different types of fins were used which includes longitudinal fins, circular/annular fins, and plate fins. For example, it has been experimentally investigated the melting and solidification of PCM (RT35) in a plate finned tube heat exchanger. The results showed that fins lead to more uniform average temperature distribution regardless of the flow regime.

In addition, some other novel PCM heat exchangers were developed recently. A recently developed PCM heat exchanger can be used for storing warm and cold water supplied from its anisotropic wall. This new energy storage unit is a pillow plate type heat exchanger with multi flowing channels, while the PCM, sodium acetate trihydrate (SAT), works as the energy storage medium. The performance of a spiral-wound tubes heat exchanger has been experimentally and numerically studied and it was found that a solar-assisted heat pump for hot water production had a 6% to 14% increase in COP due to integration of PCM and controls. The experimental results show that such a system can meet daily hot water demand with constant hot water supply.

While the thermophysical properties of PCM and the design of the heat exchanger have been studied extensively, the contact thermal resistance is seldomly studied. Experimental work showed that contact thermal resistance could be about 50% of the total resistance to heat transfer in expanded graphite PCM composites. To date, contact thermal resistance has not been adequately modeled during the phase change of PCM with large changes in volume. Furthermore, models developed in literature ignored volumetric changes of PCM and predicted the contact thermal resistance as about 10% of total heat transfer resistance, instead of the 50% they later measured experimentally. Water heating of PCM embedded heat exchangers have been experimentally studied, and results indicated that the volume expansion rate of a 16 L expanded graphite paraffin heat exchanger (EGPHE) was 6.25% at 76° C. A semicircular groove was used to reduce thermal contact resistance between a heat exchanger, e.g., copper pipe, and PCM. On the other hand, it has been shown that thermal contact resistance could be less than 1.2% when there is tight contact between the EG-PCM and tubes carrying the heat transfer fluid. Although previous studies have determined the potential importance of contact thermal resistance in TES system design, there lacks a systematic method to quantify it and correlate it with the state-of-charge (SOC) of PCM.

The overall thermal conductivity of heat exchangers, which includes materials such as phase change materials, is critical to the performance of a thermal energy storage system. Although phase change materials have the potential to store large amounts of heat at a small temperature difference, the conductivity through the material is often limiting in system designs and requires careful consideration. Contact resistance is often a neglected part of heat exchanger design when materials themselves have low conductivity. Furthermore, in materials that have large density changes during the phase change process, the thermal contact pressure will vary when the thermal energy storage system is cycled between solid and liquid states. In most installations, the weight of the material itself cannot supply the pressure required for low thermal resistance.

SUMMARY OF THE INVENTION

A thermal energy storage system includes a heat exchange module having a housing with an open interior and a quantity of phase change material in the open interior of the housing. The phase change material has a liquid phase and a solid phase. The liquid phase has a first liquid volume and a liquid density and the solid phase has a first solid volume and a solid density different from the liquid density. The combined volume of the liquid phase and the solid phase defines a total volume of the phase change material. A change in the heat of the phase change material causes a change in the relative amount of the phase change material in the liquid phase and the amount of phase change material in the solid phase and a change in the liquid volume and the solid volume, such that the phase change material undergoes a change in total volume.

A quantity of reference gas is in fluid communication with the phase change material. The reference gas has a first reference gas pressure and first reference gas volume before a change in the heat of the phase change material, and a second reference gas pressure and second reference gas volume after a change in the heat of the phase change material.

A sensor is provided for sensing the reference gas pressure and generating a pressure signal that is related to the reference gas pressure. The exchange of heat with the heat exchange module results in a change in the heat of the phase change material, a change in the amount of phase change material in the liquid phase and in the solid phase, and a change in the total volume of the phase change material.

The change in the total volume of the phase change material will cause a change in the volume of the reference gas from the first reference gas volume to the second reference gas volume and a change in the reference gas pressure from the first reference gas pressure to the second reference gas pressure. The sensor will detect and generate a signal of the first reference gas pressure and a signal of the second reference gas pressure after the exchange of heat.

The thermal energy system can further include a processor for receiving the signal of the first reference gas pressure and the signal of the second reference gas pressure. The processor can determine from the difference in first reference gas pressure and the second reference gas pressure the change in total volume of the reference gas and of the phase change material. The processor can determine from the change in total volume of the phase change material the amount of phase change material in the liquid phase and the amount of phase change material in the solid phase after the exchange of heat with the phase change material, and the state of charge.

The sensor can in some cases continuously monitor the pressure of the reference gas as the phase change material changes phase between an entirely solid phase and an entirely liquid phase. The thermal energy storage system can be hermetic and of fixed volume. The heat exchange module can be hermetic and of fixed volume. The sensor can be within the heat exchange module. The sensor can be external to the heat exchange module and the pressure sensor can be in fluid communication with the interior of the heat exchange module.

The thermal energy storage system can further include an expansion container comprising a housing and an open interior. The expansion container can be in fluid communication with the heat exchange module. The expansion container exchanges the phase change material and/or the reference gas with the heat exchange module.

The sensor can be external to the heat exchange module and the pressure sensor can be in fluid communication with the interior of the heat exchange module. The thermal energy storage system can further include a diaphragm hermetically dividing the open interior of the expansion container into first and second portions, wherein the first portion is in fluid communication with the heat exchange module and the second portion is fluidically isolated from the heat exchange module. The sensor can be in fluid communication with the first portion of the expansion container. The thermal energy storage system can further include a second sensor in fluid communication with the second portion of the expansion container. The sensor is in fluid communication with the second portion of the expansion container.

The sensor can be attached to the diaphragm. The sensor can sense the position of the diaphragm. The sensor can include a strain gauge for measuring the strain of the diaphragm.

A method for storing thermal energy can include the steps of providing a thermal energy storage system including a heat exchange module. The heat exchange module includes a housing with an open interior and a quantity of phase change material in the open interior of the housing. The phase change material has a liquid phase and a solid phase. The liquid phase has a first liquid volume and a liquid density and the solid phase has a first solid volume and a solid density different from the liquid density. The combined volume of the liquid phase and the solid phase define a total volume of the phase change material. A change in the heat of the phase change material causes a change in the relative amount of the phase change material in the liquid phase and the amount of phase change material in the solid phase and a change in the liquid volume and the solid volume, such that the phase change material undergoes a change in total volume. A quantity of reference gas having a reference gas pressure and volume is in fluid communication with the phase change material. A sensor is provided for sensing the reference gas pressure and generating a pressure signal that is related to the reference gas pressure.

Heat is exchanged with the heat exchange module. With the exchange of heat with the heat exchange module there will be a change in the heat of the phase change material, a change in the amount of phase change material in the liquid phase and in the solid phase and a change in the total volume of the phase change material. The change in the total volume of the phase change material will cause a change in the volume of the reference gas from the first reference gas volume to the second reference gas volume and a change in the reference gas pressure from the first reference gas pressure to the second reference gas pressure. The sensor detects and generates a signal of the first reference gas pressure and a signal of the second reference gas pressure after the exchange of heat.

The thermal energy storage system can further include a processor, and the method can include the steps of the processor receiving the signal of the first reference gas pressure and the signal of the second reference gas pressure. The processor determines from the difference in first reference gas pressure and the second reference gas pressure the change in total volume of the phase change material. The processor can determine from the change in total volume of the phase change material the amount of phase change in the liquid phase and the amount of phase change material in the solid phase after the exchange of heat with the phase change material.

The method can further include the steps of providing an expansion container comprising a housing and an open interior. The expansion container is in fluid communication with the heat exchange module. The method further comprises the step of exchanging at least one selected from the group consisting of the phase change material and the reference gas between the expansion container and the heat exchange module upon a change in heat of the phase change material. The sensor can continuously monitor the pressure of the reference gas as the phase change material changes phase between an entirely solid phase and an entirely liquid phase.

A thermal energy storage system includes a heat exchanger and a phase changing material configured to undergo a phase transition between a liquid phase and a solid phase at a critical temperature. The phase change material is thermally coupled with the heat exchanger, so the phase change material and the heat exchanger exchange latent heat during the phase transition. A sensor module is mechanically coupled with a particular surface of the phase change material and configured to sense a change of a mechanical property associated with the particular surface that is caused by the phase transition, and output a sensing value corresponding to the mechanical property. A processor module is configured to receive the sensing value, access a mapping of sensing values to states of charge of the phase change material, wherein a state of charge of the phase change material is a ratio of the mass of either the phase change material solid phase or the phase change material liquid phase to the total mass of the phase change material, and determine, during operation of the thermal energy storage system, an instant state of charge of the phase change material based on the received sensing value and the accessed mapping. The sensor module can comprise an array of contact pressure sensors distributed over the particular surface and sandwiched between the phase change material and the heat exchanger. The contact pressure sensor array can be configured to sense a change in contact pressure caused by the phase transition, and output a corresponding contact pressure value. The processor module can be configured to receive the contact pressure value, access a mapping of contact pressure values to states of charge of the phase change material, and determine, during operation of the thermal energy storage system, the instant state of charge of the phase change material based on the received contact pressure value and the accessed mapping. The array of contact pressure sensors can include a haptic sensor array.

The thermal energy storage system can include an expansion tank that comprises a diaphragm, wherein the expansion tank is configured to encapsulate, between the diaphragm and its walls, at least a portion of the phase change material. The sensor module can include a deflection sensor disposed on the diaphragm. The deflection sensor can be configured to sense a deflection of the diaphragm caused by the phase transition, and output a corresponding diaphragm deflection value. The processor module can be configured to receive the diaphragm deflection value, access a mapping of diaphragm deflection values to states of charge of the phase change material, and determine, during operation of the thermal energy storage system, the instant state of charge of the phase change material based on the received diaphragm deflection value and the accessed mapping.

The mapping of sensing values to states of charge of the phase change material can correspond to a linear correlation between the sensing values and the states of charge of the phase change material. The mapping of sensing values to states of charge of the phase change material corresponds to a nonlinear relationship between the sensing values and the states of charge of the phase change material. The mapping of sensing values to states of charge of the phase change material can include a hysteresis. The processor module can be configured access the mapping in a lookup table.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
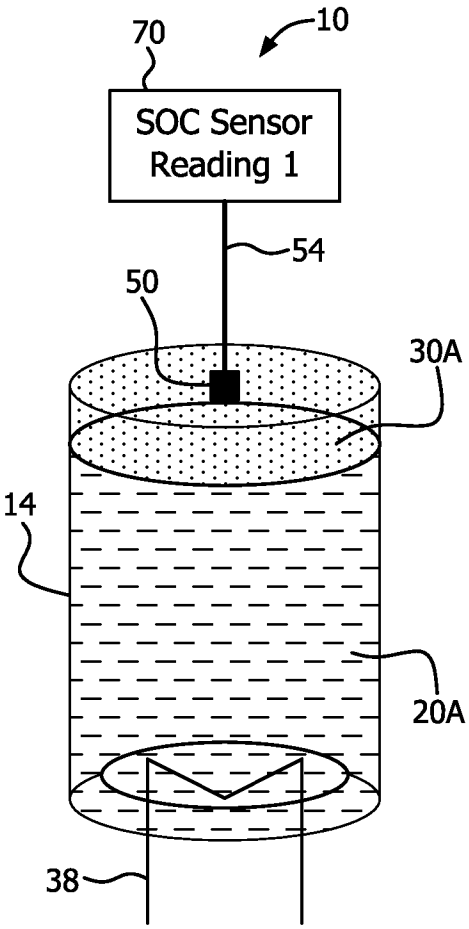
FIG. 1 is a schematic depiction of a thermal energy storage system in a first mode of operation.

A thermal energy storage system according to the invention includes a heat exchange module having a housing with an open interior and a quantity of phase change material in the open interior of the housing. The phase change material has a liquid phase and a solid phase. The liquid phase has a first liquid volume and a liquid density and the solid phase has a first solid volume and a solid density different from the liquid density. The combined volume of the liquid phase and the solid phase define a total volume of the phase change material. A change in the heat of the phase change material causes a change in the relative amount of the phase change material in the liquid phase and the amount of phase change material in the solid phase, and thereby a change in the liquid volume and the solid volume, such that the phase change material undergoes a change in total volume. The total volume of the phase change material has a maximum when the phase change material is entirely in one phase which can be liquid or solid depending on the phase change material that is used, and a minimum when the phase change material is entirely on the other phase. The change in the total volume of the phase change material provides the state of charge of the phase change material.

A quantity of reference gas is in fluid communication with the phase change material. The reference gas has a first reference gas pressure and first reference gas volume before a change in the heat of the phase change material, and a second reference gas pressure and second reference gas volume after a change in the heat of the phase change material.

The exchange of heat with the heat exchange module will cause a change in the heat of the phase change material, a change in the amount of phase change material in the liquid phase and in the solid phase, and a change in the total volume of the phase change material. The change in the total volume of the phase change material will cause a change in the volume of the reference gas from the first reference gas volume to the second reference gas volume and a change in the reference gas pressure from the first reference gas pressure to the second reference gas pressure. The sensor will detect and generate a signal of the first reference gas pressure and a signal of the second reference gas pressure after the exchange of heat. This change in pressure of the reference gas is thereby related to the change in the total volume of the phase change material, which is in turn related to the proportion of phase change material in the liquid or solid state and also thereby the state of charge of the phase change material and the heat exchange module.

A processor can be provided for receiving the signal of the first reference gas pressure and the signal of the second reference gas pressure. The processor determines from the difference in first reference gas pressure and the second reference gas pressure the change in total volume of the reference gas and of the phase change material. The processor can determine from the change in total volume of the phase change material the amount of phase change material in the liquid phase and the amount of phase change material in the solid phase after the exchange of heat with the phase change material, and the state of charge.

The reference gas can be selected from different material. Qualities of a suitable reference gas include nonreactivity with the PCM and relatively low compressibility at pressures below 5 ATM (e.g., mostly consisting of monatomic or diatomic molecules). Gases suitable for use as the reference gas include air, dry air, nitrogen, argon, or other inert diatomic gas. Air is a suitable reference gas.

A sensor is provided for sensing the reference gas pressure and generating a pressure signal that is related to the reference gas pressure. Many different kinds of pressure sensors are possible. Bourdon tube pressure sensors, vacuum (Pirani) pressure sensors, sealed pressure sensors, piezoelectric pressure sensors, and strain gauge pressure sensors are common sensors that could be suitable. A portion of the pressure sensor can be external to the heat exchange change module and the pressure sensor can extend into the heat exchange change module and can be in fluid communication with the interior of the heat exchange module to sense the pressure of the reference gas within.

The housing of the phase change material can take many different designs, sizes, and materials. Steel or plastic drums, hot-water tanks, and plastic shape conforming containers are all examples of bulk PCM encapsulation.

The thermal energy storage system can be hermetic and the heat exchange module can be of fixed volume. The heat exchange module can alternatively have a somewhat variable volume as pressure increases and decreases, and the processor can configured and programmed to account for the variable volume in determining the state of charge. The heat exchange module housing can be hermetic and of fixed volume. The sensor is in such embodiments is positioned within the heat exchange module.

The thermal energy storage system can further include an expansion container comprising a housing and an open interior. The expansion container is in fluid communication with the heat exchange module, and exchanges at least one of the phase change material and the reference gas with the heat exchange module. The pressure sensor can be external to the heat exchange module and the pressure sensor can be in fluid communication with the interior of the heat exchange module so as to be able to sense the pressure therein.

A diaphragm can hermetically divide the open interior of the expansion container into first and second portions. The first portion is in fluid communication with the heat exchange module and the second portion is fluidly isolated from the heat exchange module. The pressure sensor can be in fluid communication with the first portion of the expansion container. A second sensor can be in fluid communication with the second portion of the expansion container. The pressure sensor can be in fluid communication with the second portion of the expansion container. The pressure sensor can be attached to the diaphragm. The pressure sensor can sense the position of the diaphragm. The pressure sensor can include a strain gauge for measuring the strain of the diaphragm, from which the pressure of the reference gas can be determined. The pressure sensor can continuously monitor the pressure of the reference gas as the phase change material changes phase between an entirely solid phase and an entirely liquid phase, or between any state of charge within these extremes. The pressure sensor can determine the amount of sensible heating or cooling of the liquid past the 100% liquid phase. The pressure sensor can determine the amount of dissociation of salt-hydrates due to incongruent melting by comparing total pressure change between cycles when the same amount of heating and cooling are applied in each cycle.

A method for storing thermal energy can include the step of providing a thermal energy storage system, comprising a heat exchange module having a housing with an open interior and a quantity of phase change material in the open interior of the housing. The phase change material has a liquid phase and a solid phase. The liquid phase has a first liquid volume and a liquid density and the solid phase having a first solid volume and a solid density different from the liquid density. The combined volume of the liquid phase and the solid phase define a total volume of the phase change material, wherein a change in the heat of the phase change material causes a change in the relative amount of the phase change material in the liquid phase and the amount of phase change material in the solid phase and a change in the liquid volume and the solid volume, such that the phase change material undergoes a change in total volume.

A quantity of reference gas has a reference gas pressure and volume in fluid communication with the phase change material. A pressure sensor is provided for sensing the reference gas pressure and generating a pressure signal that is related to the reference gas pressure. The exchange of heat with the heat exchange module causes a change in the heat of the phase change material, a change in the amount of phase change material in the liquid phase and in the solid phase and a change in the total volume of the phase change material. The change in the total volume of the phase change material will cause a change in the volume of the reference gas from the first reference gas volume to the second reference gas volume and a change in the reference gas pressure from the first reference gas pressure to the second reference gas pressure. The pressure sensor will detect and generate a signal of the first reference gas pressure and a signal of the second reference gas pressure after the exchange of heat. The change in the total volume of the phase change material, and thereby the state of charge, can be determined from the change in the reference gas pressure.

The manner by which heat is exchanged with the heat exchange module can vary. Such methods include convection, conduction and radiation. The invention can be utilized in a variety of different systems and in most uses where thermal energy storage is required.

The thermal energy storage system can further comprise a processor. The method includes the steps of the processor receiving the signal of the first reference gas pressure and the signal of the second reference gas pressure—and can include the time. The processor determines from the difference in first reference gas pressure and the second reference gas pressure the change in total volume of the phase change material. The method can further include the steps of the processor determining from the change in total volume of the phase change material the amount of phase change in the liquid phase and the amount of phase change material in the solid phase after the exchange of heat with the phase change material.

The method can also include the steps of providing an expansion container comprising a housing and an open interior, where the expansion container is in fluid communication with the heat exchange module. At least one of the phase change material and the reference gas are exchanged between the expansion container and the heat exchange module upon a change in heat of the phase change material.

A thermal energy storage system can include a heat exchanger and a phase change material configured to undergo a phase transition between a liquid phase and a solid phase at a critical temperature. The phase change material is thermally coupled with the heat exchanger, so the phase change material and the heat exchanger exchange latent heat during the phase transition. A sensor module is mechanically coupled with a particular surface of the phase change material and configured to sense a change of a mechanical property associated with the particular surface that is caused by the phase transition, and output a sensing value corresponding to the mechanical property. A processor module is configured to receive the sensing value, and access a mapping of sensing values to states of charge of the phase change material. A state of charge of the phase change material is a ratio of the mass of either the phase change material solid phase or the phase change material liquid phase to the total mass of the phase change material. The processor can determine, during operation of the thermal energy storage system, an instant state of charge of the phase change material based on the received sensing value and the accessed mapping.

The sensor module can include an array of contact pressure sensors distributed over the particular surface and sandwiched between the phase change material and the heat exchanger. The contact pressure sensor array can be configured to sense a change in contact pressure caused by the phase transition, and output a corresponding contact pressure value. A processor module is configured to receive the contact pressure value, access a mapping of contact pressure values to states of charge of the phase change material, and determine, during operation of the thermal energy storage system, the instant state of charge of the phase change material based on the received contact pressure value and the accessed mapping.

The array of contact pressure sensors can include a haptic sensor array. An expansion tank can include a diaphragm. The expansion tank is configured to encapsulate, between the diaphragm and its walls, at least a portion of the phase change material. The sensor module comprises a deflection sensor disposed on the diaphragm. The deflection sensor is configured to sense a deflection of the diaphragm caused by the phase transition, and output a corresponding diaphragm deflection value. The processor module is configured to receive the diaphragm deflection value, access a mapping of diaphragm deflection values to states of charge of the phase change material, and determine, during operation of the thermal energy storage system, the instant state of charge of the phase change material based on the received diaphragm deflection value and the accessed mapping.

The mapping of sensing values to states of charge of the phase change material can correspond to a linear correlation between the sensing values and the states of charge of the phase change material. The mapping of sensing values to states of charge of the phase change material can correspond to a nonlinear relationship between the sensing values and the states of charge of the phase change material. The mapping of sensing values to states of charge of the phase change material can include a hysteresis. The processor module can be configured access the mapping in a lookup table.

The thermal energy storage system can be used generally for analytical instrumentation in fields such as energy and utilities. More particularly, the disclosed technologies can be used for characterizing phase change materials for deployment in closed systems.

Figure 10:
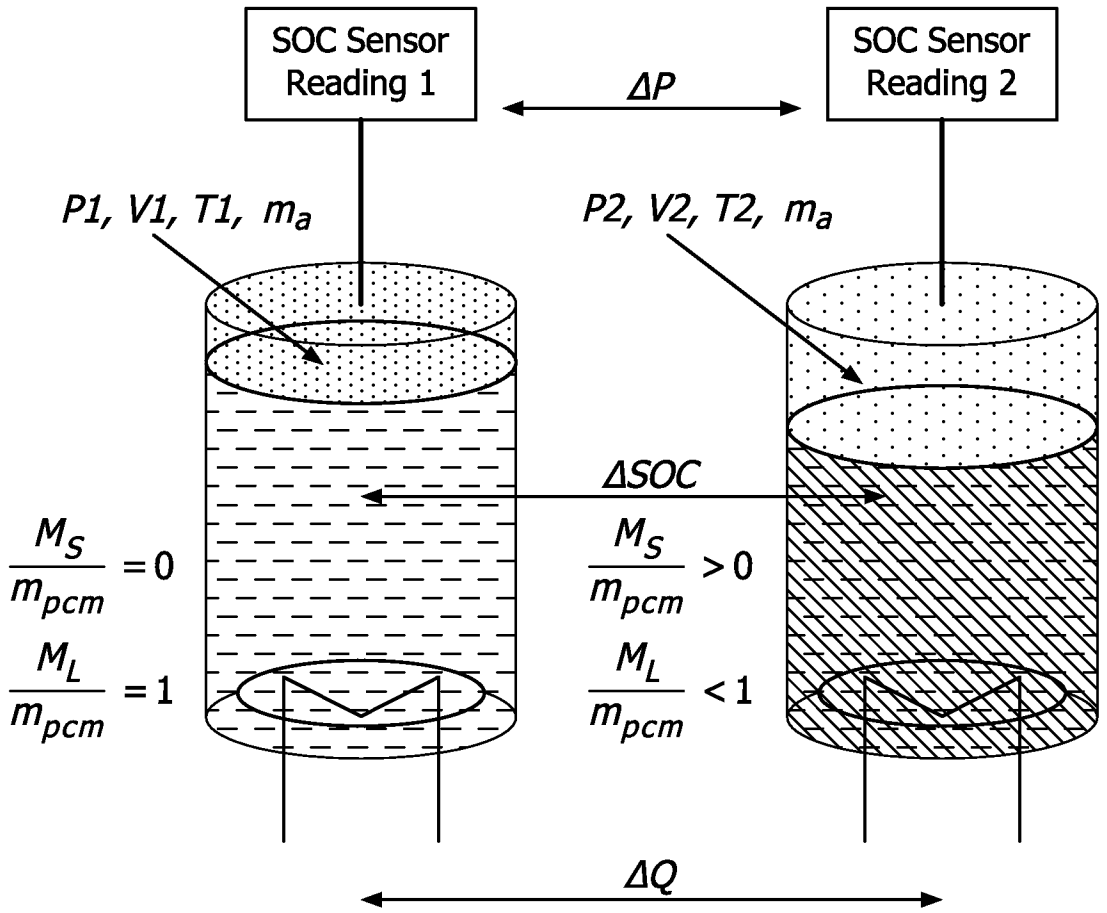
FIG. 10 is a schematic depiction of a thermal energy storage system.

The relationship between state of charge and pressure change from the solid state to the liquid state (state 1 to state 2 (ΔSOC)) for the simplest case is show in FIG. 10. The state of charge is the amount of heat energy gained or released (ΔQ) during the phase change process from liquid to solid or vice versa. The quantity ΔQ is divided by the total energy that can be stored, $m_{PCM}H_{LF}$. The following physical variables are measurable and accounted for in empirical equations for a real system:

Air (reference gas) status from state 1 to state 2
- Air pressures: $P_1$ and $P_2$
- Air volumes: $V_1$ and $V_2$
- Air temperatures: $T_1$ and $T_2$
- $\Delta P = P_2 - P_1$ Phase change material status from state 1 to state 2
- Total mass of PCM: $m_{PCM}$ (kg)
- Density of PCM at solid and liquid state: $r_S$ and $r_L$ ($kg/m^3$)
- Mass of PCM liquid: $M_L$ (kg)
- Mass of PCM solid: $M_S$(kg)

Heat entering or leaving through heat exchanger: ΔQ (J)

Latent heat of fusion: $H_{LF}$ (kJ/kg)

$\Delta_{SOC}$ can be determined by equation (1) or equation (2) The change in state of charge for the case that includes both solid and liquid phases is:

$$\Delta_{SOC} = \frac{\rho_S \rho_L}{m_{PCM}(\rho_S - \rho_L)} \frac{[V_1 \Delta P - m_a R(T_2 - T_1)]}{P_1 + \Delta P} \quad (1)$$

where, $DP=P_2-P_1$ is the pressure change from state 1 to state 2, which can be measured by the pressure sensor; $m_a$ is the mass of the air; R is the universal gas constant. The ratio $$\frac{\rho_S \rho_L}{m_{PCM}(\rho_S - \rho_L)}$$

accounts for properties of the phase change material and the mass of the phase change material placed in the container. The ratio $$\frac{[V_1 \Delta P - m_a R(T_2 - T_1)]}{P_1 + \Delta P}$$

accounts for the impact of the change in properties of the phase change material from the liquid to solid state or vice versa, by changing pressure ΔP between the two states. The change in temperature difference of the air, $m_a R(T_2-T_1)$, is expected to have a maximum impact of 10% on the reading and be accounted for empirically. The change in state of charge can also be expressed based on the amount of phase change material that is in the liquid or solid state and the amount of heat that has entered or left through the heat exchanger:

$$\Delta SOC = \frac{\Delta Q}{m_{PCM} H_{LF}} = M_S/(M_L + M_S) \quad (2)$$

To determine the effects of the container volume change that is associated with the pressure change applied by the phase change of the phase change material a simple experiment can be conducted. Air can be used to charge the container intended to be used with the phase change material in the absence of the phase change material. The container will be charged to an initial pressure (likely atmospheric) and then up to a final pressure where the mass of the air added is measured at the same time the pressure is measured. Using the gas laws, the amount of volume change the container experienced from the addition of this mass of air can be determined. The volume change of the container for the associated pressure will be known. This information of the container volume changes at an associated pressure will be used in a second experiment that includes the phase change material, and the volume change of the container can be subtracted from the analysis associating the volume change of the phase change material to yield an accurate state of charge of the phase change material.

Figure 2:
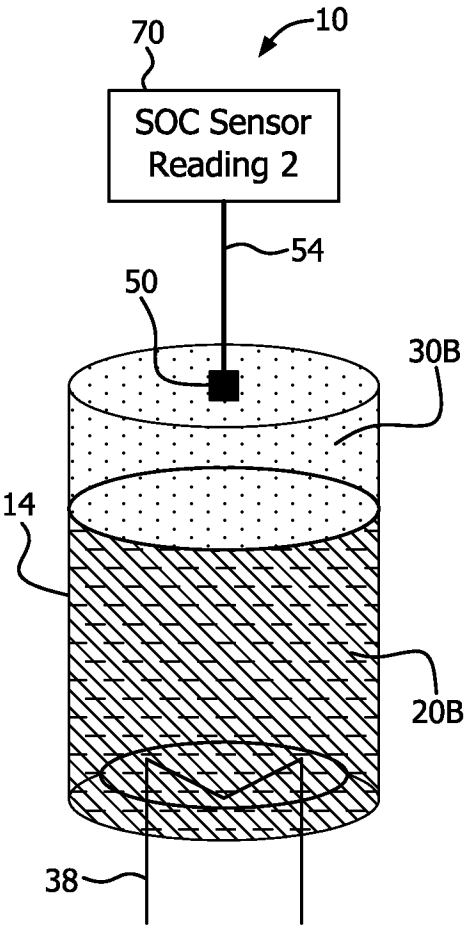
FIG. 2 is a schematic depiction of the thermal energy storage system in a second mode of operation.
Figure 3:
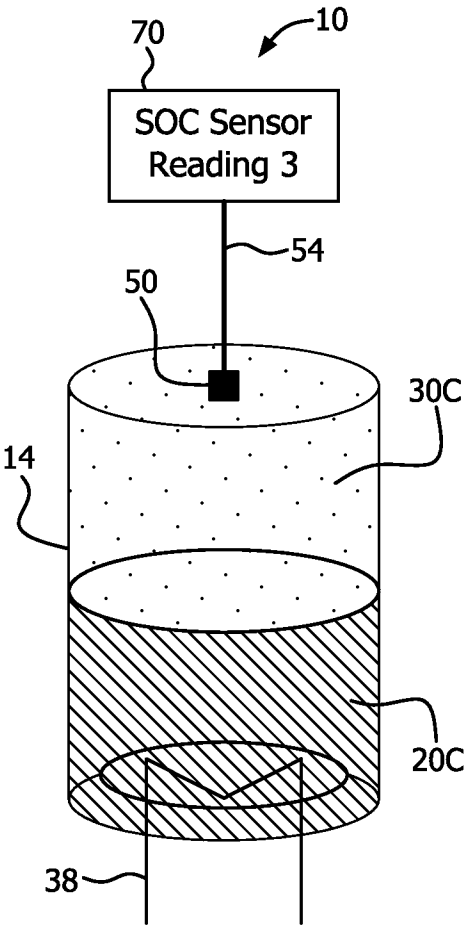
FIG. 3 is a schematic depiction of the thermal energy storage system in a third mode of operation.

There is shown in FIGS. 1-3 a thermal energy storage system 10 which includes a heat exchange module comprising an enclosed housing 14. Within the housing 14 is a phase change material 20 and a reference gas 30. Heat transfer to the housing 14 is symbolized by heating element 38, but it should be appreciated that this is symbolic for any manner of heat exchange with the phase change material 20. A pressure sensor 50 communicates with the interior of the housing 14 to sense pressure of the reference gas 30. The pressure sensor 50 generates a signal which travels through a communication line 54 to a pressure sensor device 70 which can be a processor. As shown in FIG. 1, in a first state of the phase change material 20 that is symbolized by 20A the phase change material is in a first state of charge, for example entirely liquid. In the depicted first state of charge 20A, the total volume of the phase change material is at a maximum. Accordingly, the volume available to the reference gas 30 is at a minimum and depicted by 30A for this first state of charge. The pressure sensor device 70 accordingly has a first Sensor Reading 1 for this initial sate of charge.

In FIG. 2 the phase change material has an intermediate state of charge 20B which is some mixture of the liquid and solid phases. In this state of charge, the total volume of the phase change material is reduced from that of phase change material 20A in FIG. 1. The volume available for the reference gas 30B is a greater than that available to the reference gas 30A in FIG. 1. The pressure sensor 50 will thereby read a lower pressure and will communicate this through communications line 54 to the pressure sensing device 70 as Sensor Reading 2.

In FIG. 3 there is shown a third state of charge in which the phase change material 20C has become substantially entirely solid. There is a larger volume within the housing 14 available to the reference gas 30C, which will now indicate a lower pressure to the pressure sensor 50. This lower pressure will be communicated by communications line 54 to the pressure sensing device 70 as Sensor Reading 3.

Figures 4, 5, 6:
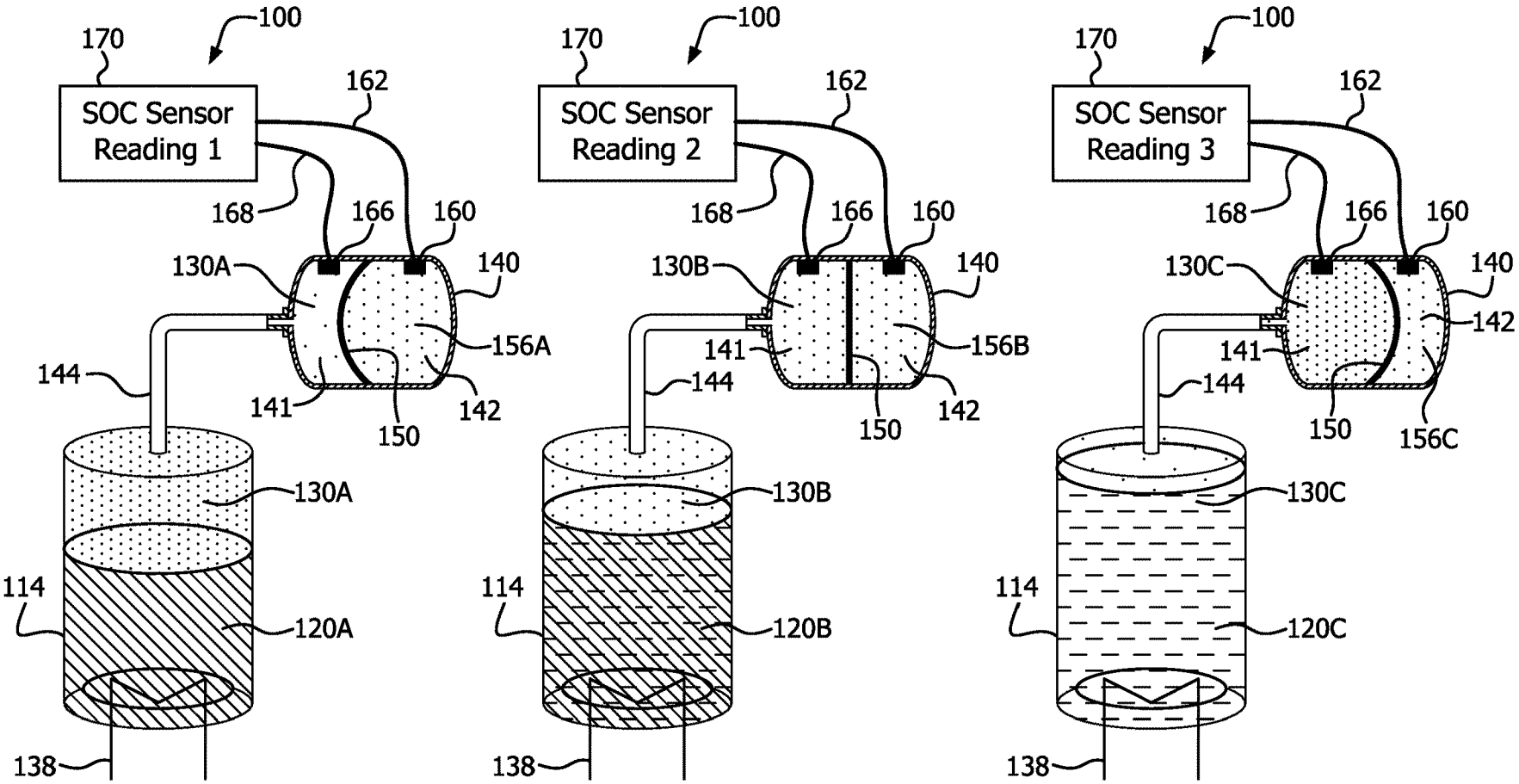
FIG. 4 is a schematic depiction of an alternative thermal energy storage system in a first mode of operation.
FIG. 5 is a schematic depiction of the alternative thermal energy storage system in a second mode of operation.
FIG. 6 is a schematic depiction of the alternative thermal energy storage system in a third mode of operation.

There is shown in FIG. 4 a thermal energy storage system 100 which includes a heat exchange module comprising an enclosed housing 114. Within the housing 114 is a phase change material 120 and a reference gas 130. Heat transfer to the phase change material 120 is symbolized by heating element 138, but it should be appreciated that this is symbolic for any manner of heat exchange with the phase change material 120.

An expansion container 140 communicates with the housing 114 through conduit 144 such that reference gas 130 can travel through the conduit 144 into the expansion container 140 the expansion container 140 has a flexible diaphragm 150 which separates the expansion container into two hermetic compartments. A first compartment 141 receives the reference gas 130 and a second compartment 142 contains a second gas 156 which can be the same as the reference gas 130 or can be a different gas. A pressure sensor 160 is provided to sense the pressure of the second gas and communicate this pressure through a communications line 162 to a pressure sensing device 170. A pressure sensor 166 is provided to sense the pressure of the reference gas 130 in the expansion container 140 and communicate this pressure through a communications line 168 to the pressure sensing device 170.

In FIG. 4 there is shown a first state of charge in which the phase change material 120A is substantially solid and has a lower total volume. This increases the total volume available to the reference gas 130A in this first state of charge resulting in a lower pressure of the reference gas 130A in the first compartment 141 of the expansion container 140. The lower pressure will draw the flexible diaphragm 150 toward the first compartment 141 and expand the second compartment 142. The pressure of the second gas 156A will thereby be reduced and this will be sensed by the pressure sensor 160 and communicated to the pressure sensing device 173 the communications line 162.

In FIG. 5 there is shown a second state of charge for the thermal energy storage system 100 in which the phase change material is in a state of charge with a mixture of liquid and solid indicated by 120B. The total volume of the phase change material 120 B is increased from the total volume of the phase change material in 120A in the first state of charge. This will reduce the volume available to the reference gas 130B within the housing 114 and will accordingly raise the pressure of the reference gas 130B in the housing 114 and through the conduit 144 to the reference gas 130B in the first compartment 141. The increased pressure of the reference gas 130B in the first compartment 141 will move the flexible diaphragm 150 toward the second compartment 142, raising the pressure of the second gas 156B. This pressure will be read by sensor 160 in communicated to the pressure sensing device 170 by communications line 162. The pressure of the reference gas 130B within the first compartment 141 will be read by the pressure sensor 166 and communicated by communications line 168 to the pressure sensing device 170. This will register as Sensor Reading 2.

There is shown in FIG. 6 a third state of charge for the thermal energy storage system 100. In this state of charge, the phase change material 120C is entirely liquid and the total volume of the phase change material 120C is at a maximum. The volume available in the housing 114 to the reference gas 130C is thereby a minimum, causing an increase in the pressure of the reference gas 130C. This is communicated through the conduit 144 to the first compartment 141. The increased pressure of the reference gas 130C in the first compartment 141 will flex the diaphragm 150 further into the second compartment 142, reducing the volume available to the second gas 156C and raising its pressure. This pressure of the second gas 156C will be read by the pressure sensor 160 and communicated by communications line 162 to the pressure sensing device 170. The pressure of the reference gas 130C in the first compartment 141 will be read by the pressure sensor 166 and communicated by communications line 168 to the pressure sensing device 170 as Sensor Reading 3.

Figure 7:
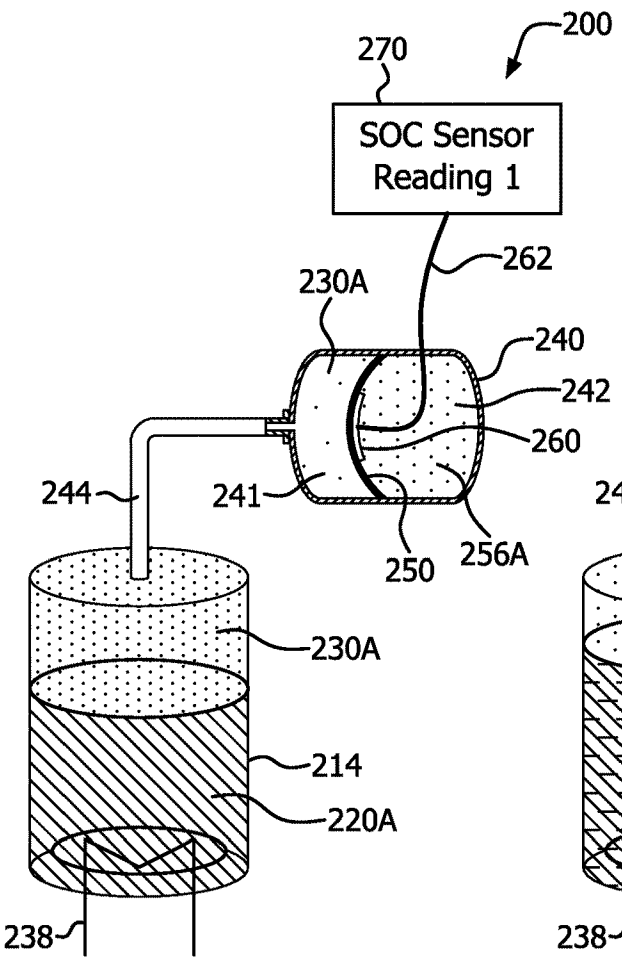
FIG. 7 is a schematic depiction of a second alternative thermal energy storage system in a first mode of operation.

There is shown in FIG. 7 a thermal energy storage system 200 which includes a heat exchange module comprising an enclosed housing 214. Within the housing 214 is a phase change material 220 and a reference gas 230. Heat transfer to the housing 214 is symbolized by heating element 238, but it should be appreciated that this is symbolic for any manner of heat exchange with the housing 214.

An expansion container 240 communicates with the housing 214 through conduit 244 such that reference gas 230 can travel through the conduit 244 into the expansion container 240. The expansion container 240 has a flexible diaphragm 250 which separates the expansion container into two hermetic compartments, a first compartment 241 which receives the reference gas 230 and a second compartment 242 which receives a second gas 256 which can be the same as the reference gas 230 or can be a different gas. The flexible diaphragm 250 will flex toward the first compartment 241 or toward the second compartment 242 depending on the pressure of the reference gas 230. This flexure can be detected by a suitable sensor 260 such as a strain sensor. The strain sensor communicates through communications line 262 to a pressure sensing device 270 which can interpret that flexure.

In the first state of charge shown in FIG. 7, the phase change material 220A is substantially solid and at a minimum volume. This leaves a greater space for the volume of the reference gas 230A in the housing 214 and through the conduit 244 also the reference gas 230A in the first compartment 241 of the expansion container 240. This will draw the flexible diagram 250 toward the first compartment 241. The pressure sensor 260 will record this lecture and reported through communications line 262 to the pressure sensing device 270 as Sensor Reading 1.

Figure 8:
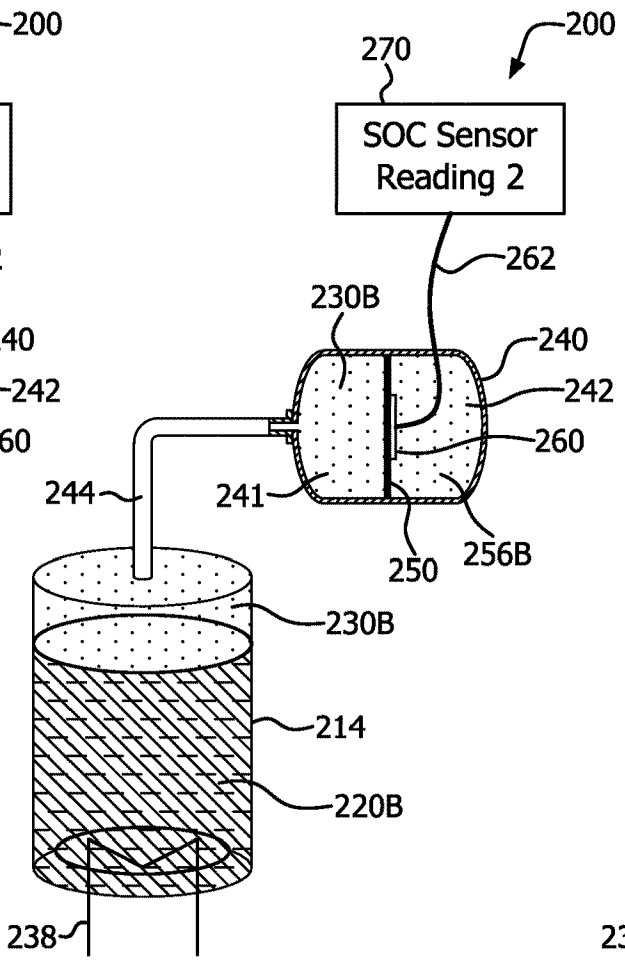
FIG. 8 is a schematic depiction of the second alternative thermal energy storage system in a second mode of operation.

There is shown in FIG. 8 a second state of charge for the thermal energy storage system 200. In this state of charge there is a mixture of solid and liquid indicated by phase change material 220B. The total volume of the phase change material 220B is increased from the total volume of the phase change material 220A, reducing the volume that is available within the housing 214 to the reference gas 230B. Accordingly the pressure of the reference gas 230B in the housing 214 and of the reference gas 230 within the first compartment 241 of the expansion container 240 is increased. This increase in pressure will cause the flexible diaphragm 250 to move toward the second compartment 242. This flexure will be detected by the pressure sensor 260 and communicated through communications line 262 to the pressure sensing device 270 as Sensor Reading 2.

Figure 9:
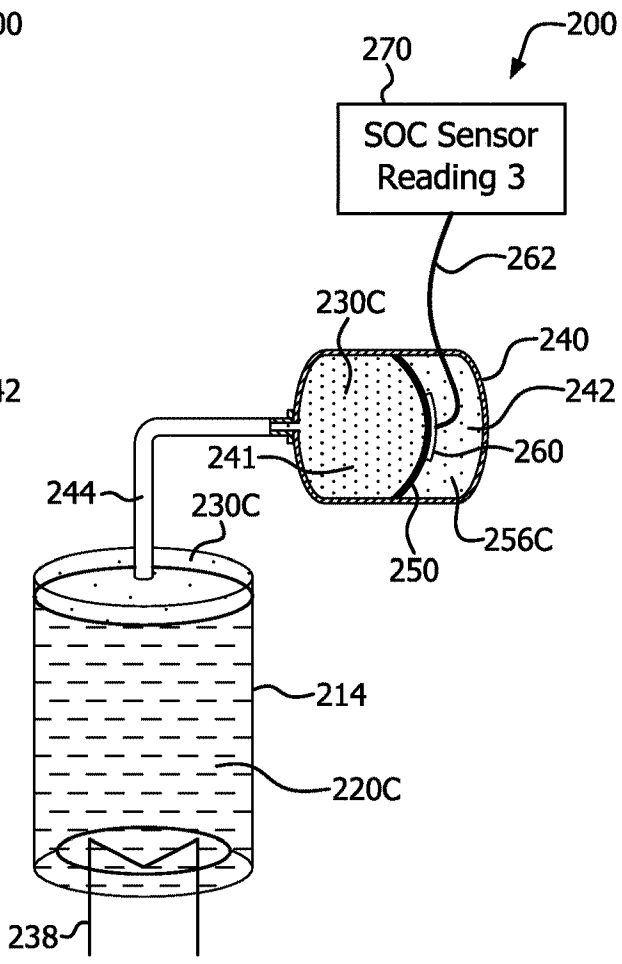
FIG. 9 is a schematic depiction of the second alternative thermal energy storage system in a third mode of operation.

There is shown in FIG. 9 a third state of charge for the thermal energy storage system 200. In this third state of charge, the phase change material 220 C is almost entirely liquid, such that the total volume of the phase change material 220 C is at a maximum. The volume within the housing 214 that is available to the reference gas 230 C is reduced, increasing the pressure of this reference gas 230 C both in the container 214 and through the conduit 244 in the first compartment 241 of the expansion container 240. This increase in pressure of the reference gas 230 C within the first compartment 241 of the expansion container 240 because further flexure of the flexible diaphragm 250 toward the second compartment 242. This will further compress the second gas 256C. The pressure sensor 260 will sense this flexure, and will communicate this through communications line 262 to the pressure sensing device 270 and indicate Sensor Reading 3.

EXPERIMENTAL

More importantly to the determination of the thermal contact pressure, a state of charge of a phase change material can be determined by correlating pressure changes to enthalpy measured by a heat flow meter machine, which uses ASTM C1784 to determine enthalpy of the phase change material in solid and liquid states. A heat flow meter apparatus was modified to measure contact pressure throughout a phase change process to determine the impact of this density change. The output provides an empirical factor of conductivity based on material expansion for use in thermal energy storage system that undergoes a phase change.

Instruments used to measure the phase change dependent contact pressure for phase change materials with large volumetric change during phase transition include 10 haptic sensors wired in parallel, a Fox 305 HFMA ("HFMA"), and a data acquisition system (DAQ). The HFMA allows characterization of insulative and phase change materials by controlling the temperature inside the device with high accuracy and measuring the heat flux into and out of the material at steady-state conditions. The HFMA provides extremely precise readings: 0.6 mV resolution on integrating high output heat flux transducers, 0.001" precision in thickness measurement, and 0.01° C. temperature control and resolution. The precise readings of conductivity from the HFMA were critical to obtain a highly accurate and sensitive contact pressure measurements.

A contact pressure sensor was placed inside the HFMA to measure contact pressure of phase change materials that undergo a large volumetric phase change during phase transition in conductivity-based measurements. The pressure sensor used a series of thin-film pressure sensors, also known as haptic sensors. Ten of these sensors were wired in parallel to determine an average pressure experienced under the HFMA test. A high-resolution CR6 DAQ system was used to create a half-bridge circuit to measure the resistance of these sensors. The standard error of the excitation voltage was +−0.02% which is applied to create a ½ Wheatstone bridge. The sensor was sandwiched between multiple materials to ensure good reading. It includes a layer of highly conductive copper plate, a layer of silicon plastic pads, and a layer of high conductivity flexible material such as thermal pads for CPU heat sinks. The copper plate was used to spread the heat evenly through the sensor. The sensor was then attached to the copper plate with a layer of silicon plastic pads to protect the electronics on its top surface. Lastly, it was topped with a flexible material that engaged the haptic sensor for the baseline test. The phase change material test includes adding a vacuum-sealed bag of phase change material on top of this material stack—414 grams of Pure Temp 15 was used in the phase change material test.

The experiment included several steps: 1) determine pressure HFMA can provide by altering a potentiometer inside apparatus which controls four motors close to test samples; 2) determine sandwich pads materials to pair with haptic sensor for best reading; 3) remove any temperature dependent drift in readings from resistive type sensors; 4) determine conductivity of the baseline material stack; 5) calculate contact conductivity in the baseline test; 6) add PCM to the material stack inside HFMA and calculate change in contact conductivity as the HFMA works through a temperature range; and 7) determine the relationship of resistive reading to state of charge for the PCM at its phase change temperature.

Flexible materials were tried to determine the pressure applied by the HFMA. The materials needed to have elastic deflection under applied loads of the HFMA for the thickness reading in the HFMA to be linear. A stiff fiberglass pad was found suitable because it can withstand the pressure applied by the HFMA, e.g., 0.2 to 1.2 psi, and deflects linearly. To calibrate the deflection of this material, the fiberglass was placed between stiff plastic plates, and deflection was measured under varying loads.

Four calibration weights, e.g., two 25.00 lb. weights, one 6.61 lb., and one 11.02 lb. weight and one known mass, were used to develop the relationship between pressure and deflection. The known weight was a 5-gallon bucket of water measured on a 0.5% accurate scale to be 32.94 lb. The deflection under varying weights was measured at 20 points along the edge of the material stack. To engage the pressure sensor a highly flexible material is required. Initially a silicone mat was used.

The limit was the thermal resistance of this material, which had at conductivity of 0.1402 W/mK and a small thickness. Some phase change material samples will have higher conductivity. This precision was then replicated with a material of high enough conductivity while still being thin, to allow the HFMA to determine the thermal conductivity of the phase change material to be tested. Two thermal contact pads with 6 w/mK conductivity were chosen as to not limit the range of the material tested. Finally, a series of tests were conducted to determine the thermal drift of the ten sensors.

The HFMA allows setting multiple temperatures inside the machine and stepping through these temperatures with high accuracy, e.g., <0.5% variance in temperature and heat flux readings. A separate DAQ system was built to read the signal from the resistive sensor during this internal temperature sweep. One CPU was used to record both resistive measurements and HFMA temperatures. This allowed readings to be averaged by aligning timestamps of DAQ and HFMA output as it went through setpoints.

Early experiments showed hysteresis in loading and unloading the sample to the amount of deflection measured. Under the initial loading, before nonlinear deflection, the linearity of the behavior was quite good. When the material is sufficiently stiff, the nonlinear behaviors can be ignored. On the other hand, if the material is too stiff, the haptic sensor cannot determine a steady reading; thus, the stiffness of the material and the resistive reading are coupled. In this second stage of development, the material needed to be flexible enough for the haptic sensor to give good data.

Correlation for applied load to deflection of fiberglass was determined. The correlation for the HFMA machine voltage to auto thickness of machine output for this fiberglass sample was also determined. These two correlations are combined and the error in the measurements propagated together to determine the voltage applied at the HFMA to the pressure. The error was propagated in EES and is rather large due to only 3 data points found in the linear region when the HFMA machine was compressing the fiberglass pad. The error can be reduced by taking more data points before taking on experimental work that uses the correlation, e.g., starting the tests under different contact pressures.

Regardless of the first 3 correlations, a baseline test was undertaken to determine conductivity of the material stack as temperature increased. This is likely due to the temperature dependance of the CPU pad. The contact conductivity in the test that included the PCM was later calculated by removing the conductivity temperature dependance of the material stack.

The temperature correction correlation for the sensor was determined. The baseline conductivity of the material stack was correlated to temperature by $k=0.127(T)+22.5$ for the temperature range of 17.5 to 30 C with a R2 of 0.999. This conductivity difference based on temperature was removed from the conductivity measurement of the phase change material by applying a 12.7% reduction in contact conductivity due to the temperature dependence of the material stack below the phase change material. The relationship between contact resistance and haptic sensor resistance was clear.

The contact conductivity is very low, and the thickness assumed was 0.0254 mm for each of the 6 locations of contact between the materials in the sensor and the PCM. Each layer inside the HFMA will have different contact resistances and thicknesses. Since the purpose of the study was to show the relationship between the pressure sensor and the contact resistance or conductivity, actual values calculated are less important at this point of the research.

The state of charge for one sample was correlated to the contact conductivity from the resistance of the haptic sensor by the equation $CC=0.00085-(RR)0.000000377$.

It should be noted that resistance reading is very sensitive to the material in contact with the sensor. This equation works for high conductivity materials selected for these experiments and a resistor used in the half wheatstone bridge.

The HFMA applied a large heat flux in the first 11 minutes of the 10-hour experiment to freeze the sample at 15° C. The calculated imbalance of heat flux would result in a 41% frozen phase change material sample after this first block. The HFMA continued to freeze the sample and then warm it back. A correlation between the resistance readings and the state of charge calculations was only present after the phase change material was warmed back to the 41% frozen state. The HFMA plates are fixed throughout the experiment that the phase change material could simply have shrunk too much for pressure sensor to pick up the reading.

The contact resistance can be correlated to the reading from the resistive sensor with high confidence when combined with the HFMA machine. Furthermore, the state of charge can also be correlated with this same sensor setup. The absolute resistance reading is repeatable between experiments but is highly dependent on the configuration of the material stack used in conjunction with the phase change material.

Furthermore, plastic deformation in the material stack with the sensor will lead to a nonlinear result. The HFMA and haptic sensors created an environment in which the expansion of the phase change material undergoing phase change could be adequately characterized. The results described here clearly show that as the phase change material changes phase inside an enclosure the contact pressure changes and this can be used to calculate the contact conductivity and more importantly to thermal energy storage systems, the state of charge.

Finally, the concept of using a pressure sensor or an expansion tank with a deflection reading to determine the state of charge of phase change material in the field is proven possible in this disclosure. Further, resistance readings can be correlated to absolute contact pressure. Furthermore, correlations for multiple phase change materials can be developed. Additionally, a full-scale thermal storage unit that outputs the state of charge by a simple measurement device, e.g., pressure or diaphragm deflection sensor, can be developed.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alternations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A thermal energy storage system, comprising:

a heat exchange module having a housing with an open interior and a quantity of phase change material in the open interior of the housing, the phase change material having a liquid phase and a solid phase, the liquid phase having a first liquid volume and a liquid density and the solid phase having a first solid volume and a solid density different from the liquid density, the combined volume of the liquid phase and the solid phase defining a total volume of the phase change material, wherein a change in the heat of the phase change material causes a change in the relative amount of the phase change material in the liquid phase and the amount of phase change material in the solid phase and a change in the liquid volume and the solid volume, such that the phase change material undergoes a change in total volume, the heat exchange module further comprising a heat exchange module reference gas creating a heat exchange module reference gas vapor head over the phase change material;

an expansion container comprising a housing and an open interior, the expansion container being in fluid communication with the heat exchange module, the expansion container further comprising a diaphragm hermetically dividing the open interior of the expansion container into first and second portions, wherein the first portion and the diaphragm are in fluid communication with the heat exchange module reference gas vapor head of the heat exchange module through a port located in the first portion and the second portion is fluidically isolated from the heat exchange module and hermetically sealed from the surrounding atmosphere, the first portion of the expansion container exchanging the heat exchange module reference gas with the heat exchange module through the port;

a quantity of the heat exchange module reference gas being in fluid communication with the phase change material, the heat exchange module reference gas having a first pressure and first volume before a change in the heat of the phase change material, and a second pressure and second volume after a change in the heat of the phase change material;

a quantity of an expansion container reference gas in the second portion of the expansion container, the expansion container reference gas being different that the heat exchange module reference gas, the expansion container reference gas being fluidically isolated from the heat exchange module reference gas and having an expansion container reference gas pressure and an expansion container reference gas volume;

a sensor for sensing the expansion container reference gas pressure and generating a pressure signal that is related to the expansion container reference gas pressure, wherein at least a portion of the sensor is within the second portion of the expansion container;

wherein with the exchange of heat with the heat exchange module there will be a change in the heat of the phase change material, a change in the amount of phase change material in the liquid phase and in the solid phase, and a change in the total volume of the phase change material;

wherein the change in the total volume of the phase change material will cause a change in the volume of the heat exchange module reference gas from the first volume to the second volume and a change in the pressure of the heat exchange module reference gas from the first pressure to the second pressure, and wherein the change in volume and pressure of the heat exchange module reference gas will cause a change in the position of the diaphragm and thereby a change in the expansion container reference gas volume and the expansion container reference gas pressure; and, wherein the sensor will detect and generate a signal of the expansion container reference gas pressure after the exchange of heat, and wherein the sensor continuously monitors the pressure of the expansion container reference gas as the phase change material changes phase between an entirely solid phase and an entirely liquid phase.

2. The thermal energy storage system of claim 1, further comprising a processor for receiving the signal of the reference gas pressure, the processor determining from the expansion container reference gas pressure the change in total volume of the heat exchange module reference gas and of the phase change material.

3. The thermal energy storage system of claim 2, wherein the processor determines from the change in total volume of the phase change material the amount of phase change material in the liquid phase and the amount of phase change material in the solid phase after the exchange of heat with the phase change material, and the state of charge.

4. The thermal energy storage system of claim 1, wherein the thermal energy storage system is hermetic and of fixed volume.

5. The thermal energy storage system of claim 1, wherein the sensor is attached to the diaphragm.

6. The thermal energy storage system of claim 5, wherein the sensor senses the position of the diaphragm.

7. The thermal energy storage system of claim 6, wherein the sensor comprises a strain gauge for measuring the strain of the diaphragm.

8. The thermal energy storage system of claim 1, wherein the sensor continuously monitors the pressure of the expansion container reference gas as the phase change material changes phase between an entirely solid phase and an entirely liquid phase.

* * * * *